United States Patent [19]

Morin

[11] 4,391,199

[45] Jul. 5, 1983

[54] SAFE AMMUNITION FOR EXHIBITION AND TARGET SHOOTING

[76] Inventor: Lionel Morin, 20, avenue Gambetta, 19200 Ussel, France

[21] Appl. No.: 190,261

[22] Filed: Sep. 24, 1980

[51] Int. Cl.[3] ..... F42B 5/22; F42B 9/20

[52] U.S. Cl. ..... 102/444; 102/374; 102/498; 102/529

[58] Field of Search ..... 102/430, 444, 445, 446, 102/447, 498, 501, 520, 517, 529, 483, 372, 373, 374

[56] References Cited

U.S. PATENT DOCUMENTS

| | | | |
|---|---|---|---|
| 1,489,165 | 2/1923 | Spencer . | |
| 2,064,503 | 12/1936 | Temple . | |
| 2,918,003 | 12/1959 | Temple | 102/531 |
| 3,339,487 | 9/1967 | Stadler et al. | 102/444 |
| 3,342,134 | 9/1967 | Stadler et al. | 102/444 |
| 3,388,665 | 6/1968 | Koehler . | |
| 4,123,868 | 11/1978 | Wilson . | |
| 4,135,322 | 1/1979 | Tice . | |

FOREIGN PATENT DOCUMENTS

| | | | |
|---|---|---|---|
| 6919 | 1/1879 | Fed. Rep. of Germany . | |
| 505761 | 8/1930 | Fed. Rep. of Germany . | |
| 2705235 | 8/1978 | Fed. Rep. of Germany | 102/430 |
| 1442940 | 5/1966 | France | 102/444 |
| 14628 | 5/1897 | Switzerland . | |
| 514460 | 12/1939 | United Kingdom . | |

*Primary Examiner*—Harold J. Tudor

*Attorney, Agent, or Firm*—Sandler & Greenblum

[57] ABSTRACT

Safety ammunition for use with a variety of weapons has a holder, charge carrier and a projectile. The holder has a base and cylindrical and frustoconical holes. The charge carrier is retained by the holder and includes a nose, a hollow central portion which can receive a powder charge, a tail with a base, a collar between the nose and the tail, and a cover adapted to close the hollow portion at the base. The projectile has a base and central hole and is retained between the holder and the carrier. This ammunition results in lower noise levels upon shooting as well as reducing range and danger upon firing.

17 Claims, 10 Drawing Figures

1
2
3
4
5
6
7
8
9
10
11
12
13
14
15
16
17
18
19
20
21
22
34

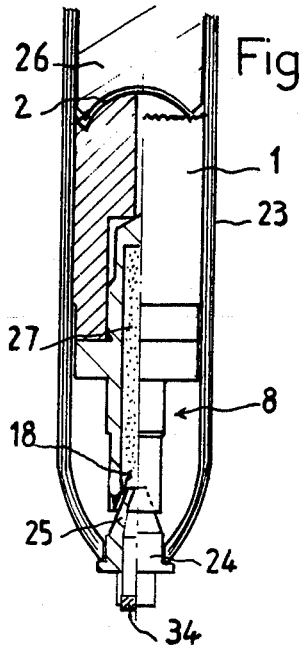
Fig.8
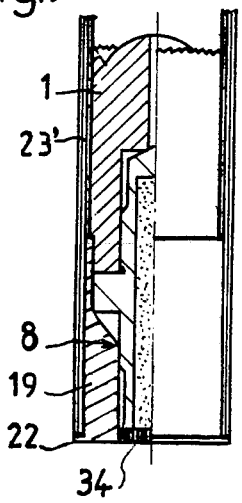
Fig.9
Fig.10
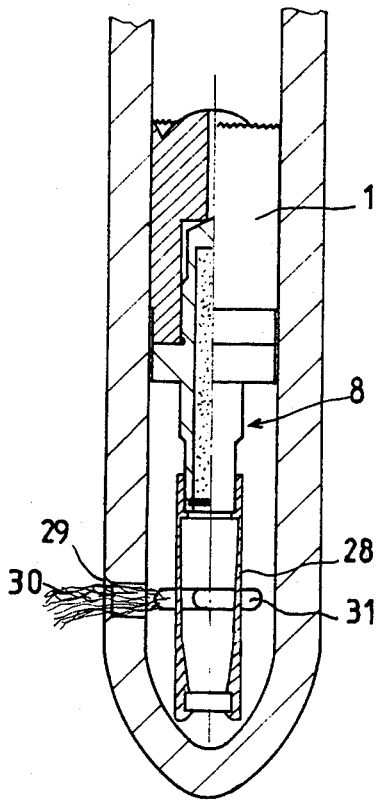

SAFE AMMUNITION FOR EXHIBITION AND TARGET SHOOTING

BACKGROUND OF THE INVENTION

1. Field of the Invention

The present invention generally relates to safe ammunition and more specifically to safe ammunition which is adapted to reduce the range noise and danger of personal weapons, both hand and shoulder held as well as old and modern weapons. The ammunition is used particularly in exhibiting and in target shooting.

2. Description of Prior Art

There are presently available on the market replicas of old hand and shoulder held weapons which use black powder. These weapons are charged either through a muzzle or through a modified breech. There are also modern hand weapons charged through a breech, modern repeating rifles which are similarly breech charged and copies of the weapons made on a reduced scale, e.g., collection type cannons and arms which are to be used with black powder and which are charged through a muzzle.

These diverse categories of weapons presently have widely varying means of being charged, by virtue of the technological and pyrotechnical evolution of the different periods; accordingly, particular ammunition is therefore required for each gun type. This is true of black powder weapons having a closed breech in which it is first necessary to pour a measured quantity of powder, after which a ball is introduced and pushed against the powder with a jamming rod. A nipple is provided at the end of the breech of these weapons for setting of the powder with a fuse.

The only ammunition which is commonly available for these devices is designed to be charged through the muzzles in several of the weapon categories listed above. Yet, it is quite obvious that in charging through the muzzle, manipulations are complicated and tiresome while the shot is very noisy and dangerous. Additionally, the shot generates smoke and causes a rapid rusting of the weapon if it is not immediately cleaned. Thus, for example, an old weapon or a replica thereof can be used for shooting but the above inconveniences rapidly discourage amateurs from using them. in order to overcome these disadvantages, the present ammunition has been conceived to permit reduced shooting levels for weapons to be used in sports and leisure activities.

SUMMARY OF THE INVENTION

It is, therefore, a first object of the present invention to provide ammunition which can be used with all firearms which are charged by either the muzzle or the breech in any appropriate caliber. It is another object of the present invention to provide ammunition which makes it possible to shoot at a reduced level which, in practice, is not a dangerous level.

A further aim of the present invention is to provide ammunition which is absolutely safe during its storage, transportation and handling.

Another aim of the present invention is to provide ammunition which is designed so that it cannot be used to shoot real bullets.

The invention has the advantage of being useable for sports and leisure shooting as well as for target shooting, whether it be with hunting weapons, hand or shoulder weapons, collector weapons, reduced scale model cannons or assault weapons, or for outdoor shooting.

These activities may be carried out in complete safety without smoke and with a minimum of noise. Furthermore, the invention does not permit the shooting of real bullets and is furthermore clearly less expensive.

The safety ammunition is adapted for shooting at a reduced level in order to minimize noise and physical danger and is also adapted to be used with dissimilar weapons. These weapons include both muzzle and breech loading weapons. The ammunition comprises a plastic charge carrier and a hollow plastic projectile coupled to the charge carrier.

The safety ammunition adapted to be used with a variety of weapons can be provided for in another aspect by a holder having a base, a cylindrical hole above the base and a frustoconical hole above the cylindrical hole. A charge carrier is adapted to be retained by the holder within the holes. The carrier comprises a nose, a hollow central portion adapted to receive a powder charge, a tail having a base, a collar between the nose and tail, and a cover adapted to close the hollow portion at the base. A projectile having a base retained within the frustoconical hole can be positioned between the holder and carrier. The projectile has a central hole adapted to receive a portion of the charge carrier and has a solid upper end. The holder, charge carrier and projectile can be assembled into a single unit with two positions, a safety position in which the projectile hole receives the tail and an armed position in which the projectile hole receives the carrier nose.

BRIEF DESCRIPTION OF THE DRAWINGS

The above and other objects, features and advantages of the present invention will now be described with reference to particular, nonlimiting embodiments with reference to the annexed drawings, in which like reference characters designate like or corresponding parts throughout the several views, and wherein:

FIG. 8 shows a half cross-sectional elevational view of safety ammunition lodged in one of the bores of the barrel of a firearm which is muzzle charged or loaded;

FIG. 9 illustrates a half cross-sectional elevational view of a cartridge lodged in the barrel of a firearm which is breech charged; and FIG. 10 illustrates a half cross-sectional elevational view of ammunition lodged in the tube of a reduced scale cannon replica.

DETAILED DESCRIPTION OF THE DRAWINGS

Figures 1, 2, 3, 4, 5:
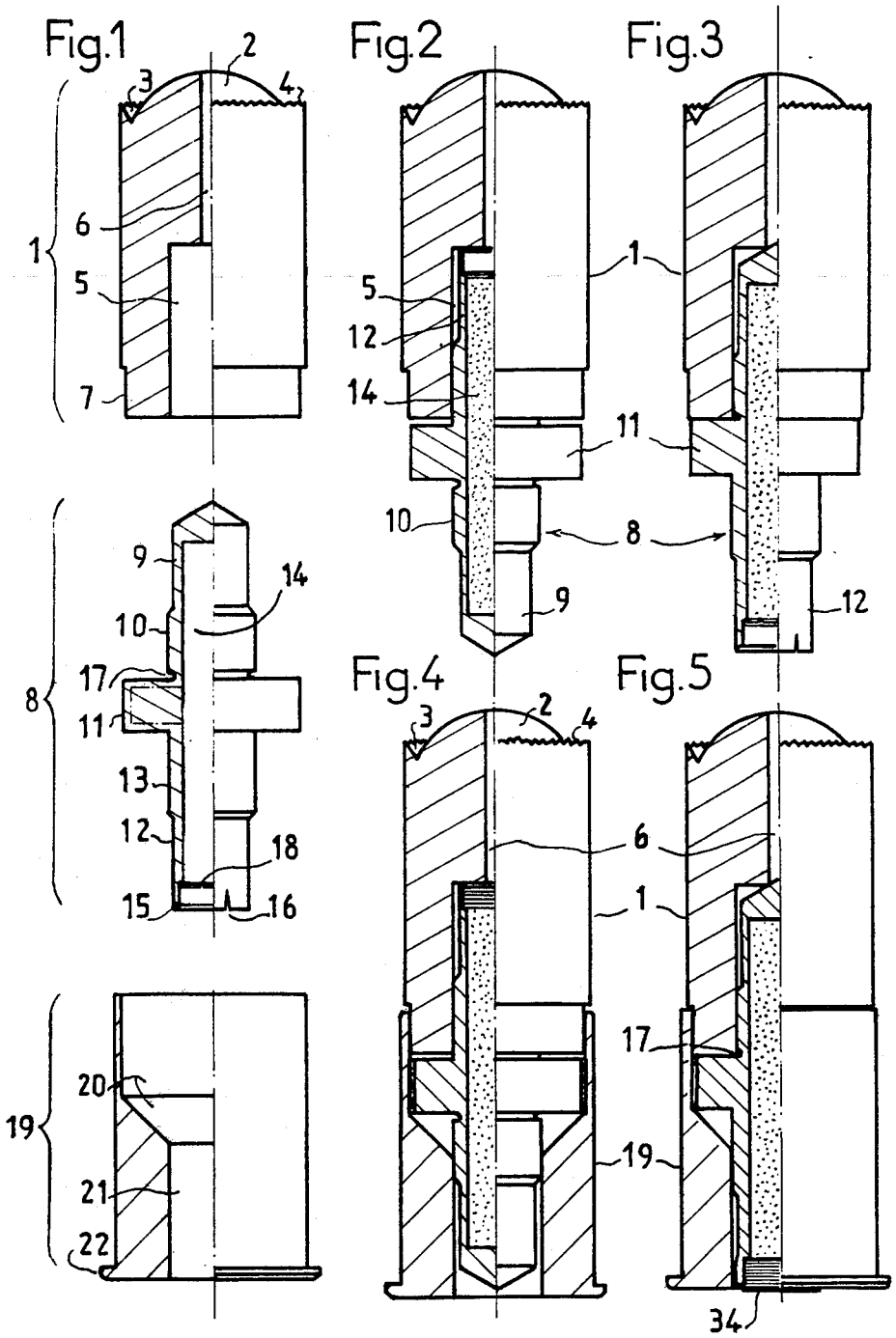
FIG. 1 is a half cutaway elevational view showing, from top to bottom, a projectile, a charge carrier and an ammunition casing formed in accordance with the present invention.
FIG. 2 is a half cross-sectional view in elevation of the safety ammunition in its "safety" position with a firearm which is charged through a muzzle.
FIG. 3 is a half cross-sectional elevational view of the ammunition of FIG. 2 in its "loaded" position.
FIG. 4 is a half elevational and cross-sectional view of a cartridge in its "safety" position for a firearm which is charged through the breech.
FIG. 5 illustrates the cartridge of FIG. 4 in its "loaded" position.

In order to achieve the above objects, the ammunition of the present invention essentially comprises, in combination, a charge carrier equipped at one of its ends with a projectile which is fitted therein. The ammunition is thus useable for all weapons which are muzzle loaded. When a holder is added, it is then useable with all breech loaded weapons. In both cases it is useable for both handguns and for shoulder weapons. It is likewise useable, as illustrated in one alternate embodiment, in reduced scale model cannons.

According to one aspect of the invention, the charge carrier is an element having the form of a tube sealed at one end. The tube is made from very thin plastic and comprises three essential portions: a tubular nose portion having a conical end; a small median collar which is solid or hollow; and a tubular tail portion of the same diameter as the nose which permits under all circumstances the holding of powder in the interior of the element and, in certain cases, a percussion fuse.

According to another aspect of the invention the charge carrier comprises a fracture line, which is preferably situated above the small collar.

According to yet another aspect of the invention, the projectile comprises plastic material and has a hollow cylindrical body terminating at its upper end in a filled semi-spherical portion bored with a central hole and surrounded by a groove and a ridged crown having teeth and extending from the sides of the cylinder. The interior hole of the cylinder receives the tail or the nose of the charge carrier, respectively, when the charge carrier is at rest and when it is in operation, respectively. These terms correspond to the "safety" and "firing" or "armed projectile" positions.

According to another characteristic of the present invention, the holder, likewise comprising plastic material, is cylindrical and hollow with an opening nesting the base of the projectile and covering the charge carrier, the holder comprising a generally conical surface against which the small collar of the charge carrier abuts while the nose or tail of the charge carrier is lodged within a hole of the base of the holder.

According to another characteristic of the invention, the neck of the holder is bored with a circular orifice which is shoulderless; this cannot serve as a support base for the firing cap, and prevents the employment of this holder as a dangerous bullet cartridge.

According to another aspect of the invention, by providing long holders of larger volume for the powder which are straight, conical or which have a restraining ring as part of a safety cartridge, ammunition is obtained which is useable in modern arms having an open breech. For this purpose, the holders are provided with a spring percussion element or extension.

According to another characteristic of the invention, the ammunition useable on a reduced scale in a weapon having a closed breech, in particular a cannon, has an extended fuse carrier which is set off with a wick across a slot provided for this purpose in the breech.

As may be seen with reference to FIG. 1, and from top to bottom, a charge carrier and a holder together constitute the safety ammunition according to the present invention. Forming the ammunition from plastic reduces the physical danger resulting from a shooting.

Projectile 1 is a hollow cylindrical body terminating at its upper end in a solid semi-spherical portion 2 comprising a peripheral groove 3 bordered by the vertical wall of the cylinder which ends in a rigid crown 4. The projectile body is hollowed out, up to about two thirds of its height, with a central hole 5. The solid portion 2 is bored with a central hole 6 opening into the hole 5. The base of the projectile has a slight peripheral nesting reduction 7. It is comprised of plastic material, preferably polystyrene.

The charge carrier 8 is a small tubular container having a closed bore therein. The carrier comprises three essential portions: a tubular nose 9 ending in a cone and comprising a bulge 10, a small median collar 11 which can be either solid or hollow, and a tail portion 12 having a bulging area 13 whose diameter is equal to that of the bulging area 10 of nose 9. The diameters of these areas correspond to the diameter of hole 5 of projectile 1. The nose has an enlarged, constant diameter generally cylindrical portion at bulge 10. The tail 12 is provided with an enlarged portion 13 having a diameter which is uniform and substantially the same as the enlarged nose portion 10.

The interior of the charge carrier is a cylindrical opening 14 of substantially constant diameter. Only base 15 of tail 12 has an opening slightly larger than the rest of the cylindrical opening; it is used for the positioning of a firing cap. The opening at the base is provided with a slight chamfered inlet and a slit 16 for force fitting the fuse therein. The slit makes the base somewhat flexible to facilitate receipt of the firing cap.

Above the small collar 11 a circular groove 17 is provided which constitutes a fracture line along which the charge carrier is broken in the course of a shot. This fracture line can be alternatively situated beneath the small collar with equivalent results.

The small median collar 11 has an exterior diameter equal to or slightly less than that of the nesting portion 7 the projectile, whose largest diameter, above the nesting zone, corresponds to the caliber of the weapon to be loaded. The height of the collar must meet two criteria: when it is solid, as shown in FIG. 1, it serves only to enhance gripping during manipulation and its proportions must only be sufficient to enable the system to easily charge the breech of a given weapon; and when it is hollow, it serves as a complimentary container for central portion 14 of the charge carrier, its height calculated for the particular requirements of the selected arm or weapon and of the profile of its normal ammunition.

Open base 15 of the charge carrier is made so as to receive cover 18, e.g., paper, which adapts cylinder 14 to admit and return the necessary quantity of powder to propel the projectile. In the example of the embodiment described, the charge carrier comprises a polyolefin.

The holder 19 is a cylindrical element whose interior is hollow, the holder having a generally frustoconical hole 20 on top of a smaller diameter cylindrical hole 21. The neck of the holder ends, in a known fashion, in a rib 22.

With reference to FIGS. 2 and 3 it will be noted that the projectile 1 is adapted to cover the charge carrier 8, either the tail 12 (FIG. 2) or nose 9 (FIG. 3) of which frictionally penetrates into hole 5 of the projectile. It is noted that bulges 10 and 13, respectively, which extend against the walls of the openings 5 and 21, assure a tight fit of the charge carrier within the projectile and the neck of the holder.

When the charge carrier is positioned as in FIG. 2, its base rests against the flat end of the filled or solid portion 2. It is then in a "safety" position whereas, as shown in FIG. 3, it is in the "armed" projectile" position.

By assembling a projectile 1 with a charge carrier 8, as described above, ammunition results which is adapted both for firearms which are hand or shoulder held and those firearms which may be charged through a muzzle, as shown in FIG. 8. As may be seen, ammunition according to the present invention, which comprises projectile 1 covering the charge carrier 8, lodges itself perfectly in closed muzzle 23 in which it is slid by means of a conventional ram rod 26 whose concave shape mates perfectly with the semi-spherical head 2 provided for this purpose on projectile 1. It will likewise be noted that frothing nipple 24 preferably has a generally frustoconical head 25 whose height is sufficient such that under pressure from ram rod 26, within the weapon, head 25 enters the interior of the charge carrier through tail 12 after tearing cover or diaphragm 18. This places head 25 of nipple 24 in contact with powder 27 contained in the charge carrier. The nipple 24 may have a conical fuse support or base.

After a shot, the charge carrier 8 breaks along fracture line 17 such that nose 9 remains associated with the projectile which is propelled towards the target while rotating. The projectile, therefore, enters into contact with the target at the same time through spherical cap 2 and the teeth of crown 4, which cut open a patch in the target and make it possible to register the exact impact of the shot. The tail 12, integral with small collar 11, leaves the barrel of the weapon and is lost.

The projectile 1 can be recovered and reused once, by merely removing the portion of nose 9 remaining blocked in hole 5 of the projectile by introducing an appropriate tool into hole 6. It will be noted that axial hole 6 additionally serves a role during a shot by enhancing the ballistics of projectiles shot a short distance.

In applying the invention to reduced scale model cannons (FIG. 10) tail 12 of the charge carrier is provided with an extended fuse carrier 28. This carrier comprises several fingers of plastic material integral with a cylinder fitted onto the base of tail 12 of the charge carrier. This accessory is adapted to maintain the ammunition at a necessary and sufficient distance from priming hole 29 such that its detonation is assured under all circumstances. In the particular case of detonation by fuse or wick 30, the wick is introduced within a capsule 31, which may contain fuse powder, through detonation orifice 29. The capsule is thus positioned between the strands of the fuse carrier and causes detonation by virtue of its explosion.

In FIGS. 4 and 5, holder 19 is illustrated as assembled with the projectile and charge carrier which nest in generally frustoconical hole 20. The small collar 11 supports the projectile penetrating into base 7 of the projectile as far as the conical throttling will got into hole 6. Either tail 12 or nose 9 of the charge carrier is securely force fitted into the cylindrical hole 21 of the neck of holder 19, dependent upon the position in which the charge carrier is placed.

In FIG. 4 the assembly is in the "safety" position while in FIG. 5, it is in the "firing" position.

By assembling the projectile and charge carrier with the holder 19, shown at the bottom of FIG. 1, and equipping base 15 of tail 12 of the charge carrier with a firing cap 34, one obtains a cartridge (FIG. 5) adapted for use with a firearm which is breech loaded, such as shown in FIG. 9. In such an embodiment, rim 22 abuts against the opening of breech 23'.

Figure 6:
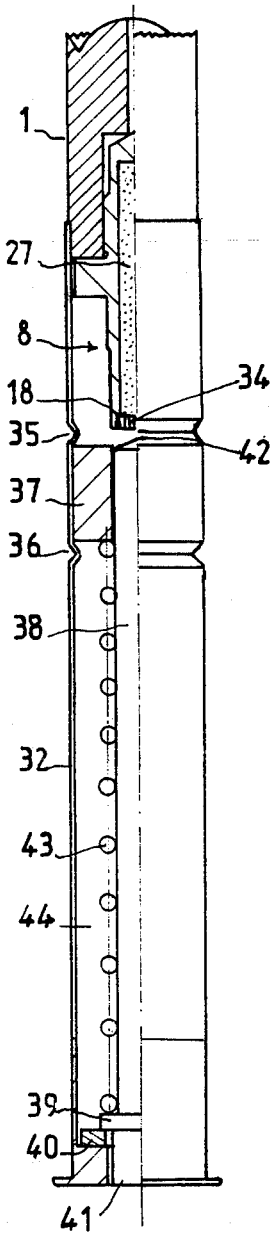
FIG. 6 illustrates a half elevational cross-sectional view of the assembly of FIG. 3 with a projectile and charge carrier associated with a straight holder for a modern rifle having an open breech.
Figure 7:
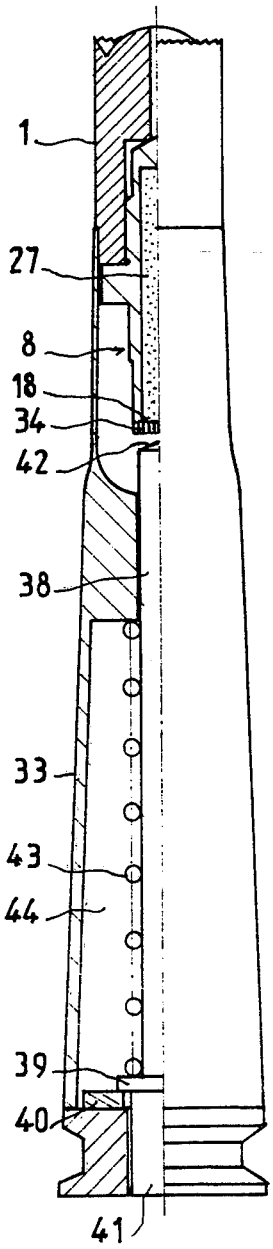
FIG. 7 illustrates a half elevational cross-sectional view of the assembly of FIG. 6 but with a holder having a tapered collar, for a modern rifle having an open breech.

As may be seen in FIGS. 6 and 7, it will be noted that base 15 of tail 12 of the charge carrier is provided with a fuse 34 force fitted into and in tight contact with closure or diaphragm 18, which retains powder 27 occupying hole 14 of the charge carrier. The small collar 11 of the latter can be hollow and additionally filled with powder when such is necessary.

The long and straight holder 32 comprises two constrictions 35 and 36 adapted to retain guide mandrel 37 interiorly of the holder. A metallic percussion extension or element 38 slides coaxially through the mandrel; the percussion element has a sufficient length so that the charge carrier 8 with its projectile 1 forced fitted in the neck of the holder, are always fit with precision. The extender includes a small collar 39 on the base of the holder which nests, by means of gas sealing washer 40, preferably made out of a elastomeric material, on an anvil 41 adapted to receive the percussion shock of the weapon. The extension transmits the shock to a punch 42 adapted to set off firing cap 34 provided on the charge carrier. The extension is biased away from the fuse by means of a spring 43, which is supported at one end against the smaller collar 39 of the extender and at its other end against the guide mandrel 37.

In the case of the long holder having the tapered neck of FIG. 7 the same elements, including the extension 38 are used, but the chamber 44 of spring 43 and/or the guide mandrel can be made integrally with the holder by plastic super molding if the holder is made out of metal or it can be molded directly by plastic molding if the holder is plastic.

For the two types of holders described in FIGS. 6 and 7, the positioning of anvil 41 does not permit the use of a firing cap because the anvil has a greater diameter than firing caps which are commercially available.

Quite obviously, the invention is not limited to the particular embodiments disclosed and extended to all equivalent embodiments falling within the scope of the claims. Thus, for example, a charge carrier and projectile which are fitted together by means of notches and ears rather than being force fitted by means as disclosed above may be used without going beyond the scope of the invention.

What is claimed is:

1. Safety ammunition adapted for shooting at a reduced level in order to minimize noise, range and physical danger, said ammunition adapted to be used with various weapons, including both muzzle loading and breech loading weapons, said ammunition comprising:

(a) a plastic charge carrier, said charge carrier comprising a small, tubular container having an interior opening and a closed, generally conical nose, said closed generally conical nose having an enlarged, constant diameter and generally cylindrical portion, a median small collar and a tail provided with an enlarged portion having a uniform diameter which is substantially the same as the enlarged nose portion, said charge carrier being generally hollow and having a narrow, circular groove positioned adjacent to said small collar, said groove comprising a fracture line;

(b) a hollow plastic projectile coupled with said charge carrier, said projectile including an interior opening adapted to receive either the tail or the nose of said charge carrier, said charge carrier and projectile including means for assembling them into a single unit having two different positions, a safety position in which said projectile opening receives said charge carrier tail, and a firing position in which said projectile opening receives said charge carrier nose; and (c) a holder coupled to said charge carrier and said projectile.

2. Safety ammunition in accordance with claim 1 futher comprising a plastic fuse carrier connected to and extending from said charge carrier.

3. Safety ammunition in accordance with claim 1 wherein said holder is longer than said carrier and said projectile.

4. Safety ammunition in accordance with claim 1 wherein said groove is above said collar.

5. Safety ammunition in accordance with claim 1 wherein said groove is below said collar.

6. Safety ammunition in accordance with claim 1 wherein said charge carrier comprises polyolefin.

7. Safety ammunition in accordance with claim 1 wherein said collar is solid.

8. Safety ammunition in accordance with claim 1 wherein said collar is hollow.

9. Safety ammunition according to claim 1 wherein said projectile comprises a generally hollow body terminating at its upper end in a solid semi-spherical portion bored with an axial hole and surrounded by a toothed crown extending generally upwardly from the sides of the cylinder and a groove adjacent to said crown between said crown and said sides.

10. Safety ammunition in accordance with claim 9 wherein said projectile has a hollow opening over approximately two thirds of its length and a reduced exterior diameter nesting zone at its base.

11. Safety ammunition in accordance with claim 9 wherein said projectile comprises polystyrene.

12. Safety ammunition according to claim 9 wherein said tail has a base portion and the interior opening of the charge carrier has a slightly larger diameter at said base for receiving a cover to retain powder in said opening, said base comprising a slight inlet chamfer and a slit, said base being adapted to receive a firing cap force fit within said base.

13. Safety ammunition in accordance with claim 12 in which said holder is a relatively short, cylindrical plastic holder which comprises a hollow frustoconical opening and a smaller diameter cylindrical opening, said projectile having a base fit within said frustoconical opening and one of said bulging areas fit within the axial hole of said projectile.

14. Safety ammunition according to claim 1 wherein said holder is relativelly long and straight and has a plurality of restrictions which retain a guide mandrel on the interior of the holder, said ammunition further comprising a percussion element slidably positioned within said mandrel, said element biased away from a firing cap held in said charge carrier by a spring held between the mandrel and a small collar of said element, an anvil positioned against said extension via a sealing washer and said mandrel having an upper end terminating in a point.

15. Safety ammunition in accordance with claim 14 wherein said mandrel and said holder comprise an integral plastic element.

16. Safety ammunition in accordance with claim 1 wherein said holder is an extended plastic fuse carrier comprising a plurality of fingers and a tail, said fingers being integral with a cylinder fitted on the base of said tail to maintain said ammunition at a predetermined distance from a fuse slot for holding a fuse, said fuse comprising a wick attached to a capsule containing fuse powder.

17. Safety ammunition in accordance with claim 1 wherein said holder has a base with a shoulderless opening, said opening having a diameter sufficiently small to prevent the introduction of a firing cap and accordingly render the transformation of said ammunition into a dangerous bullet cartridge impossible.

* * * * *

UNITED STATES PATENT AND TRADEMARK OFFICE

CERTIFICATE OF CORRECTION

PATENT NO. : 4,391,199

DATED : July 5, 1983

INVENTOR(S) : Lionel MORIN

It is certified that error appears in the above-identified patent and that said Letters Patent is hereby corrected as shown below:

Column 1, line 37, "muzzles" should read ---muzzle---.

Column 1, line 45, "in" should read ---In---.

Column 3, line 26, after "invention" insert ---,---.

Column 3, line 55, delete "larger" and insert ---large--- therefor.

Column 4, line 41, after "7" insert ---of---.

Column 5, line 6, after " "armed" " delete ---"---.

Column 5, line 59, delete "got" and substitute ---go--- therefor.

Column 6, line 21, delete "a" and substitute ---an--- therefor.

Column 6, line 41, delete "extended" and substitute ---extends--- therefor.

Column 8, line 13, delete "relativelly" and substitute ---relatively--- therefor.

Signed and Sealed this

Seventh Day of February 1984

[SEAL]

*Attest:*

GERALD J. MOSSINGHOFF

*Attesting Officer*

*Commissioner of Patents and Trademarks*